US008345898B2

(12) United States Patent
Reining

(10) Patent No.: US 8,345,898 B2
(45) Date of Patent: Jan. 1, 2013

(54) TRANSDUCER ASSEMBLY

(75) Inventor: Friedrich Reining, Vienna (AT)

(73) Assignee: AKG Acoustics GmbH, Vienna (AT)

( * ) Notice: Subject to any disclaimer, the term of this patent is extended or adjusted under 35 U.S.C. 154(b) by 936 days.

(21) Appl. No.: 12/391,015

(22) Filed: Feb. 23, 2009

(65) Prior Publication Data

US 2009/0214062 A1 Aug. 27, 2009

(30) Foreign Application Priority Data

Feb. 26, 2008 (WO) ..... PCT/AT2008/000061

(51) Int. Cl.
*H04R 25/00* (2006.01)

(52) U.S. Cl. ..... 381/184; 381/191

(58) Field of Classification Search ..... 381/184, 381/191

See application file for complete search history.

(56) References Cited

U.S. PATENT DOCUMENTS

| | | | | |
|---|---|---|---|---|
| 3,008,014 | A | 11/1961 | Williamson et al. | |
| 4,042,779 | A | 8/1977 | Craven et al. | |
| 4,399,327 | A | 8/1983 | Yamamoto et al. | |
| 6,041,127 | A | 3/2000 | Elko | |
| 6,885,751 | B2 | 4/2005 | Pribyl | |
| 2001/0016020 | A1 | 8/2001 | Gustafsson et al. | |
| 2001/0046306 | A1 * | 11/2001 | Barnert | 381/191 |
| 2002/0114476 | A1 * | 8/2002 | Pavlovic et al. | 381/152 |
| 2003/0053649 | A1 | 3/2003 | Pribyl | |
| 2003/0174852 | A1 | 9/2003 | Klinke | |
| 2003/0179890 | A1 | 9/2003 | Matsuo | |
| 2003/0209383 | A1 | 11/2003 | Whitman Fox et al. | |
| 2007/0009115 | A1 | 1/2007 | Reining et al. | |
| 2007/0009116 | A1 | 1/2007 | Reining | |
| 2009/0190775 | A1 | 7/2009 | Reining | |
| 2009/0190776 | A1 | 7/2009 | Reining | |
| 2009/0190777 | A1 | 7/2009 | Reining | |

FOREIGN PATENT DOCUMENTS

| | | | |
|---|---|---|---|
| DE | 2531161 | C1 | 1/1976 |
| DE | 30 03 178 | A1 | 8/1981 |
| DE | 20 2005 002 446 | U1 | 5/2005 |
| EP | 0 374 902 | A | 6/1990 |
| EP | 0 869 697 | A2 | 10/1998 |
| EP | 0 997 055 | A | 5/2000 |
| EP | 1 351 549 | A2 | 8/2003 |
| EP | 1 737 268 | A | 12/2006 |
| EP | 1 737 271 | A | 12/2006 |

(Continued)

OTHER PUBLICATIONS

International Searching Authority, the corresponding International Search Report dated Oct. 24, 2008, for Application No. PCT/AT2008/000061, and Written Opinion.

(Continued)

*Primary Examiner* — Zandra Smith
*Assistant Examiner* — Marvin Payen
(74) *Attorney, Agent, or Firm* — Brinks Hofer Gilson & Lione

(57) ABSTRACT

A transducer assembly includes a first electroacoustic transducer and a second electroacoustic transducer. The first and the second electrostatic transducers include an electrode and a counter electrode. An inner circumference of an outer diaphragm section lying within an outer circumference forms the counter electrode of the first electroacoustic transducer. An inner diaphragm section that lies within the inner circumference of the outer diaphragm section forms the counter electrode of the second electroacoustic transducer.

9 Claims, 9 Drawing Sheets

FOREIGN PATENT DOCUMENTS

| | | | |
|---|---|---|---|
| GB | 344967 | | 3/1931 |
| GB | 1512514 | | 6/1978 |
| JP | 57148500 | A | 9/1982 |
| WO | WO 2004/084577 | A1 | 9/2004 |
| WO | WO 2006/123263 | A | 11/2006 |
| WO | WO 2006/125870 | A | 11/2006 |

OTHER PUBLICATIONS

USPTO Office Action from U.S. Appl. No. 12/391,004, dated Feb. 28, 2012.
USPTO Office Action from U.S. Appl. No. 12/391,038, dated Mar. 13, 2012.
USPTO Office Action from U.S. Appl. No. 12/391,059, dated Mar. 13, 2012.
USPTO Office Action from U.S. Appl. No. 12/391,030 dated Jan. 4, 2012.
USPTO Office Action from U.S. Appl. No. 12/390,990, dated Nov. 23, 2011.
International Preliminary Report on Patentability and Written Opinion, dated May 18, 2010, of Application No. PCT/AT2007/000511.
International Searching Authority, the corresponding International Search Report dated Sep. 12, 2008, for Application No. PCT/AT2007/000542.
International Searching Authority, the corresponding International Search Report and Written Opinion, dated Jul. 30, 2008, of Application No. PCT/AT2007/000511.
International Searching Authority, the corresponding International Search Report and Written Opinion, dated Jul. 25, 2008, of Application No. PCT/AT2007/000513.
International Searching Authority, the corresponding International Search Report and Written Opinion, dated Jul. 25, 2008, of Application No. PCT/AT2007/000514.
Proakis, John G.; and Manolakis, Dimitris G.; "Digital Signal Processing" (Prentice Hall) 430-433, (2006).
Malham, Dave. "The Role of the Single Point Soundfield Microphone in Surround Sound Systems" *The University of York* York, UK (1998) 52-57.
Jacobsen, Finn; Barrera Figueroa, Salvador; Rasmussen, Knud "A note on the concept of acoustic center", *Acoustical Society of America Journal*, vol. 115 (2004) 1468-1473.
Salvador Barrera-Figueroa and Knud Rasmussen. "The acoustic center of laboratory standard microphones", *The Journal of the Acoustical Society of America*, vol. 120 (2006) 2668-2675.
International Searching Authority, the corresponding International Search Report and Written Opinion dated Jul. 25, 2008, of Application No. PCT/AT2007/000510.
International Searching Authority, the corresponding International Search Report and Written Opinion dated Oct. 31, 2005, of Application No. EP 05 45 0110.
USPTO Office Action from U.S. Appl. No. 11/474,124, dated Jan. 3, 2011.
USPTO Office Action from U.S. Appl. No. 11/474,124, dated Apr. 27, 2010.
Cotterell, Philip S. "On the Theory of the Second-Order Sound Field Microphone" *Department of Cybernetics* (2002) 187.
Jürgen Köller, Tetrahedron, 2001. Retrieved on Apr. 23, 2010 from http://www.mathematische-basteleien.de/tetrahedron.htm) 6.

* cited by examiner

TRANSDUCER ASSEMBLY

PRIORITY CLAIM

This application claims the benefit of priority from PCT/AT2008/000061, filed Feb. 26, 2008, which is incorporated by reference.

BACKGROUND OF THE INVENTION

1. Technical Field

This disclosure relates to devices that convert one form of energy into another or more particularly to an electrostatic transducer.

2. Related Art

Devices may record sound in close proximity to sources. Directional patterns of microphone signals may be arbitrarily changed by combining signals. Some devices do not substantially reduce a functional or a spatial domain when sound is received simultaneously at two or more transducers.

SUMMARY

A transducer assembly includes a first electroacoustic transducer and a second electroacoustic transducer. The first and the second electrostatic transducers include an electrode and a counter electrode. An inner circumference of an outer diaphragm section lying within an outer circumference forms the counter electrode of the first electroacoustic transducer. An inner diaphragm section that lies within the inner circumference of the outer diaphragm section forms the counter electrode of the second electroacoustic transducer.

Other systems, methods, features, and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
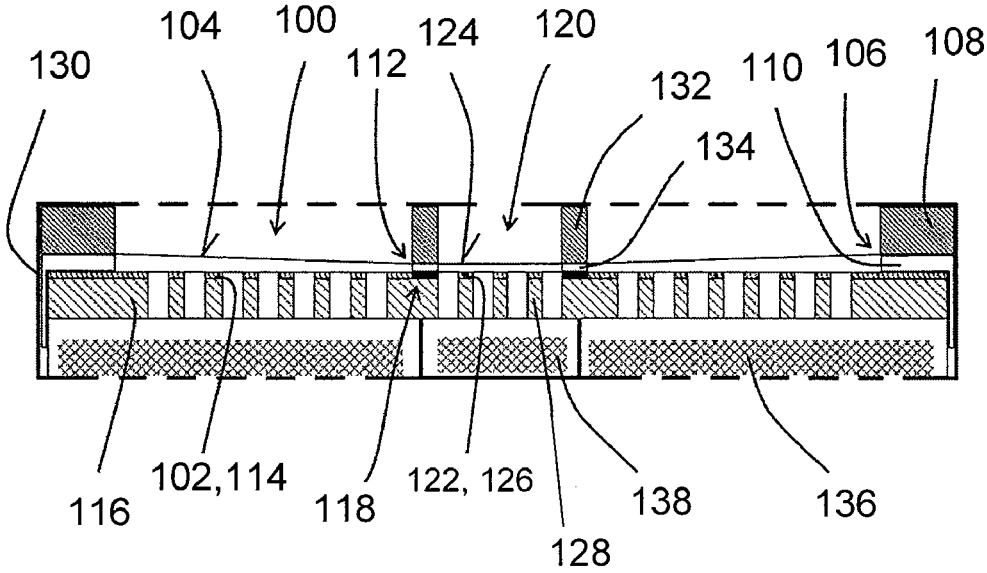
FIG. 1 a transducer assembly comprising two transducers.

A transducer assembly includes an outer diaphragm section. The outer diaphragm includes an inner circumference lying within an outer circumference. The outer diaphragm forms a counter electrode of a first electroacoustic transducer. An inner diaphragm section that lies within the inner circumference of the outer diaphragm forms the counter electrode of a second electroacoustic transducer.

The transducer layout disposes one electroacoustic transducer within another, with its counter electrode formed by the inner diaphragm lying within the outer counter electrode. The spatial coincidence is reduced to the outer circumference of the outer diaphragm section. This arrangement allows several transducers to be positioned in a small area and may accommodate capsule housings holding fixtures that have limited room to accommodate transducers. A functional gap in (or near) the center of a diaphragm may not substantially affect the operation of the assembly or cause a quality reduction. A diaphragm extending conically with respect to a center point and is fixed at (or near) the center point, may increase the assembly's sensitivity. The functional gap (or respective hole) in the outer diaphragm section may accommodate the internal diaphragm section associated with an independent transducer.

Outer and inner diaphragm sections may be selected to independently signify functioning counter electrodes that are similarly vibration-ally and electrically decoupled from each other. The selections allow for an inner and outer diaphragm sections to be parts of a single diaphragm (e.g., a unitary element) fixed in the region along the inner periphery of the outer diaphragm section. In some applications, the selections may miniaturize transducers. In an alternative system, the outer and the inner diaphragm sections are not unitary but separated from each other.

In some systems, the sound inlet openings in the capsule housings and/or the acoustic filters are formed through channelling elements or attenuating material (e.g. foam elements, etc.) so that an inner transducer forms a capsule with omnidirectional characteristics. The outer or annular transducer may act as a gradient capsule. Through contact with the respective electrodes, each impedance converter provides a capsule signal for the gradient portion and for spherical portion of the electroacoustic transducer assembly. The mixing of the two signals renders a synthesized microphone signal having electronically adjustable directional properties through the mixing ratio of the two (or more) transducers.

Aside from its sound, the directional pattern of a microphone may determine robustness toward acoustic feedback and a proximity effect. The spatial configuration of a spherical capsule and a gradient capsule may take a compact form. When a single diaphragm comprises multiple diaphragm sections, a substantial cost, and interface saving may be realized.

Some systems may be remotely controlled. When a single microphone cable is used, the output of the capsules may be combined in a mixer. An "in-phase" lead of the microphone cable may transmit the gradient signal. The "out-phase" lead of the microphone cable may transmit the spherical signal that is phase shifted within the microphone. Through this arrangement, the desired directional effect may be adjusted by weighting of the two (or more) signals without foregoing the noise immunity of the microphone cable (e.g., subtraction of the "out-phase" component from the "in-phase" component may compensate for noise due to wire-bound transmission).

The systems are not limited to microphone transducers. The system may be part of systems that receive sound that is to be reproduced and those that may require a coincident arrangement. Some systems include more than two transducers or devices that convert one form of energy into another (e.g., electric to non-electric, non-electric to electric, combinations, etc.). Additional transducers with an associated diaphragm section within the outer surrounding diaphragm section of the first transducer may be included.

FIG. 1 is a transducer assembly comprising a capsule. A shared capsule housing 130 includes two electroacoustic transducers 100, 120. The two transducers may be functionally independent from each other. Each transducer 100, 120 includes an electrode 102, 122 and a counter electrode comprising a diaphragm section 104, 124.

A single diaphragm is fixed with respect to the electrodes in the region along the border between the two diaphragm sections. The single diagram comprises diaphragm sections 104, 121, so that an oscillatory-mechanical decoupling of the two diaphragm sections occurs. A fixing ring 132, which presses against an electrically insulating spacer ring 134, is inserted between the diaphragm and the electrodes. The fixing ring 132, the diaphragm, and the inner spacer ring 134 may be joined by an adhesive (e.g., glue). The outer or peripheral diaphragm section 104 is tautened along its outer circumference 106 by an outer diaphragm ring 108 and is separated from the electrode 102 by an outer spacer ring 110.

In FIG. 1, the thicknesses of the spacers (the inner spacer ring 134 and the outer spacer ring 110) may be unequal. The behavior or type of electroacoustic transducers (e.g. gradient and spherical) may differ or may be configured differently. In spite of its smaller effective area in the shared diaphragm, the sensitivity of the spherical signal (inner transducer 120) may be adjusted along a lower space with respect to the electrode. The conical shape of the outer diaphragm section 104 may be positioned near a center point.

Figure 4:
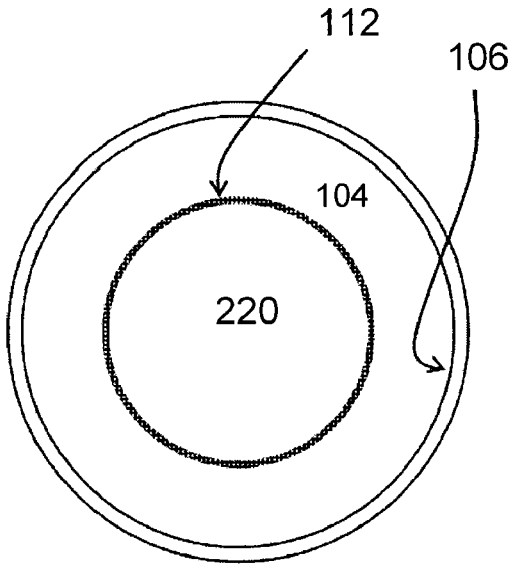
FIG. 4 shows a first contour of a diaphragm section.
Figure 5:
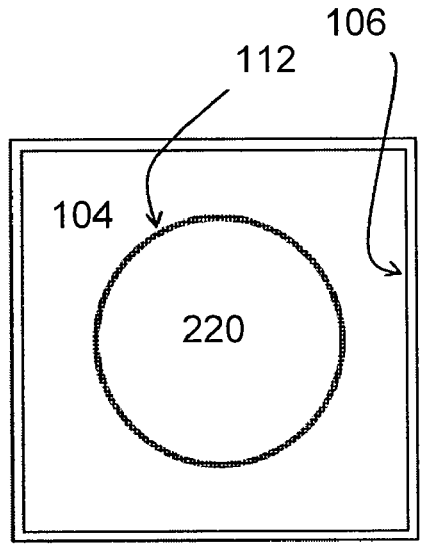
FIG. 5 shows a second contour of a diaphragm section.
Figure 6:
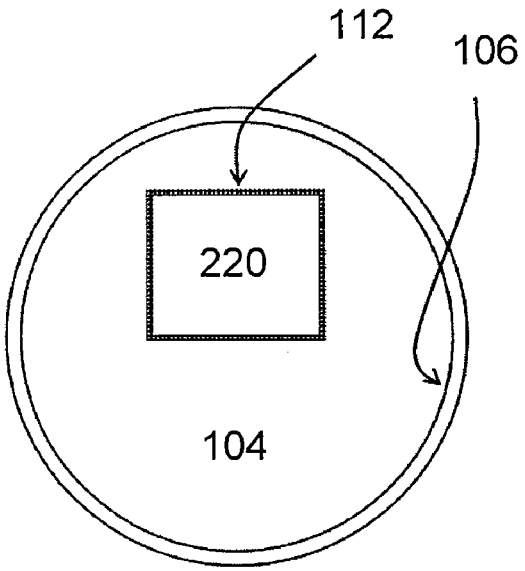
FIG. 6 shows a third contour of a diaphragm section.
Figure 7:
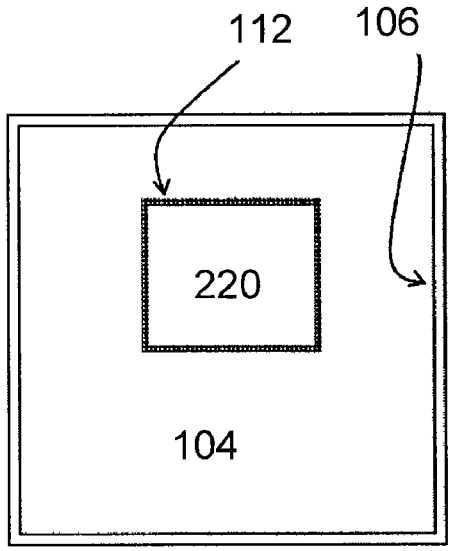
FIG. 7 shows a fourth contour of a diaphragm section.

In FIGS. 1 and 4, the peripheral diaphragm section 104 of the first transducer 104 may be limited by an outer circumference 106 and by an inner circumference 112 lying within the outer circumference 106. The inner diaphragm section 124, which is associated with the electroacoustic transducer 120, lies within the inner circumference 112 of the outer diaphragm section 104. The two diaphragm sections 104, 121 need not lie in the same plane. When separate diaphragms are used, the diaphragm planes may be offset with respect to each other. In these systems the inner diaphragm section is not substantially acoustically shadowed by the outer diaphragm section.

In some assemblers, each electrode 102, 122 includes an electrically conductive coating 114, 126, that may be applied to the surface of a one-piece, rigid electrode base 116, 128. When the two electroacoustic transducers 100, 120 border each other, the conductive material of the coating may be separated by an insulating region 118. The insulating region 118 may be positioned directly beneath the spacer ring 134. In some systems the size of the insulating material is not much smaller than the superimposed spacer ring to prevent electrical coupling of the two electrode domains.

In an alternative system, a rigid electrode comprising an electrically conductive material may replace the combination of the electrically conductive coating of the electrode and the rigid electrode base. In this assembly, the electrical insulation between the two electrodes 102, 120 may comprise a nonconductive annular insert between the electrodes.

Figure 2:
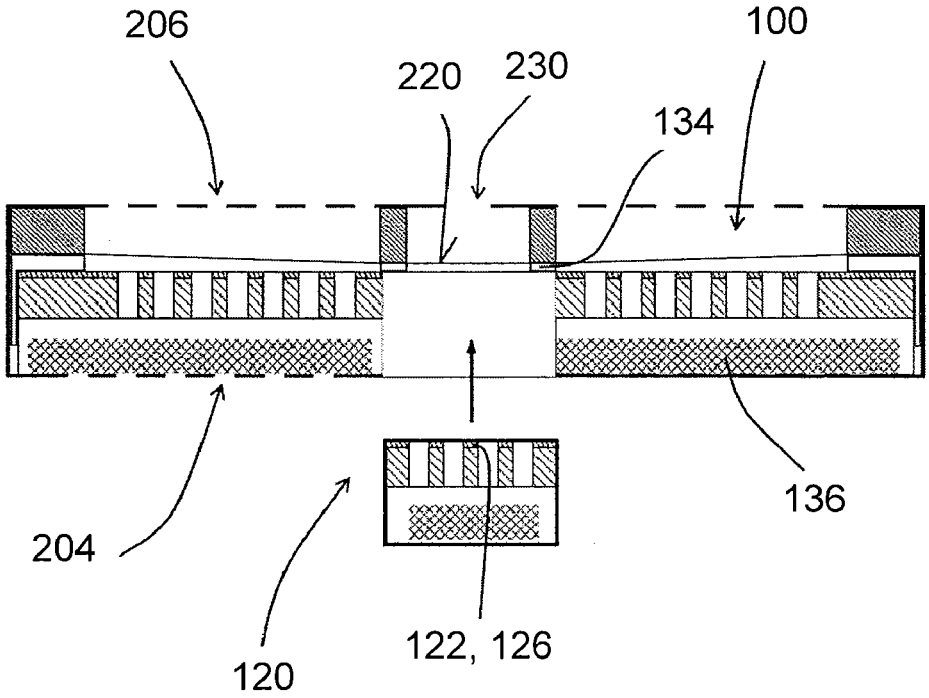
FIG. 2 is an alternative FIG. 1.

In FIG. 2, the rear portion of the inner transducer 120 enclosing the electrode 122 may be separated from its diaphragm section 220 and the remainder of the transducer assembly. Alternatively, it may be installed as a separate component. The rear part may be, for example, pressed against the diaphragm section 220 or against the spacer ring 133 by a bias or a spring force. This assembly may not require a flat electrode surface comprising metal parts and an insulating annular insert.

Figure 3:
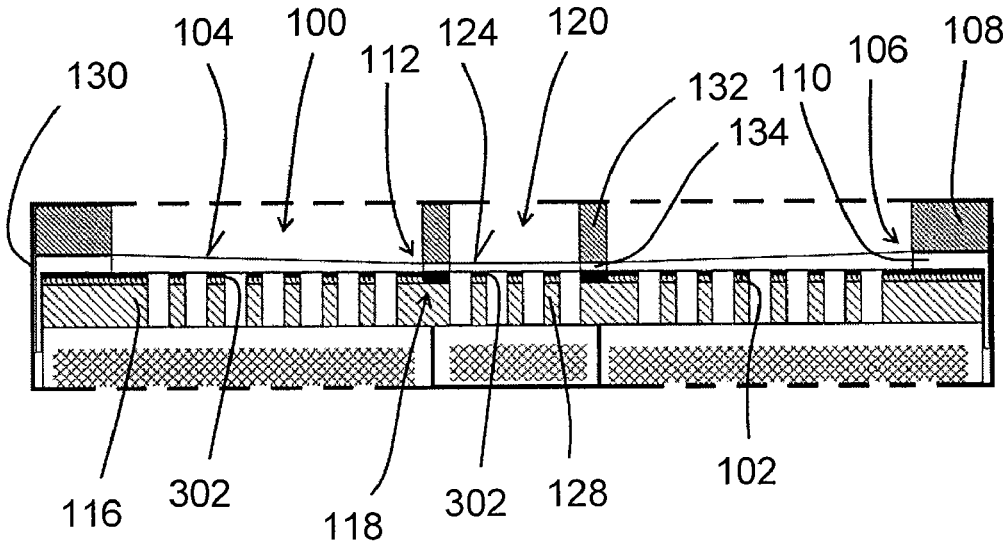
FIG. 3 a transducer assembly that exhibits an electret principle.

FIG. 3 is an alternate transducer assembly. The assembly compresses a capsule based an electret effect or persistent electric polarization. The electret layer 302 may be applied onto both electrode areas and may be charged in one act. A substantially simultaneous application may simplify production.

If the systems in which diaphragm sections 104, 124 are separated from each other, each of the transducers may have its own capsule housing. The first, outer transducer 120 may be a capsule with a pass-through hole, into which the internal transducer 100, also in the form of a capsule, may be inserted and attached. The systems of FIGS. 1 and 2 facilitate a simple interchange of transducers having different properties. Depending on the intended application, the directional characteristics, the sensitivity, and other characteristics may be changed through an interchange and combination of transducers.

FIG. 4 is a top view of the two diaphragm sections 104, 124 of the transducer assembly. In this system, diaphragm sections 104, 124 have a substantially circular circumference and are substantially concentric. In an alternative system, the inner diaphragm section 220 may be displaced from a center of the outer diaphragm section 104. In other alternate systems, diaphragm sections have a triangular shape, a square shape, a multi-angular shape, an oval shape, or other shapes. In some systems, the two diaphragm sections are formed by multiple (e.g., two, three, or more) separate diagrams.

In FIG. 1, the first electroacoustic transducer 100 may comprise a pressure gradient transducer. The openings 206 lead to the front of the outer diaphragm section 104 and openings 204 located on the back side of the capsule housing lead to the back of the diaphragm section 104. The second electroacoustic transducer 120 may comprise a pressure transducer that may have a substantially spherical directional pattern. The transducer 120 may comprise a 0-th-order transducer. Some capsule housing's 130 have only a sound inlet opening 230 opening to the front of the inner diaphragm section 220. In FIG. 1, the synthesized signals may be generated by many weighting functions and many combinations of gradient and spherical signals.

Acoustic filters or in alternate systems friction elements 136, 138, may selectively pass selected acoustic signals. The acoustic filters may adjust the properties of each transducer 100, 120. Some filters or acoustic elements may comprise foam elements, fleece elements, etc., that may allow each transducer to be adjusted separately. The gradient transducer may be adjusted to generate a hypercardioid. The mixing of the two-transducer signals allows the directional pattern to be adjustable between a hypercardioid and a sphere-like response.

The interconnection (addition of the two transducer signals) may limit the adjustable range of the resulting directional pattern to the characteristics of two acoustic transducers. By subtracting the two signals, all directional patterns may be established through a cardioid and a sphere. A cardioid may be a superposition of a figure-eight and a sphere. Due to the coincidence of the two acoustic transducers, the spherical portion of the gradient transducer 100 may be affected by a good approximation by a subtraction of the spherical transducer signal, which results in the directional characteristics.

The interconnection of the individual transducer signals may occur on the capsule side, (e.g., electrically before the impedance converter), or after the impedance converter (e.g., for instance in the mixer). While the capsule side interconnection may be expensive, the signal-to-noise ratio (SNR) improves because an amplifier stage may become unnecessary.

Figure 8:
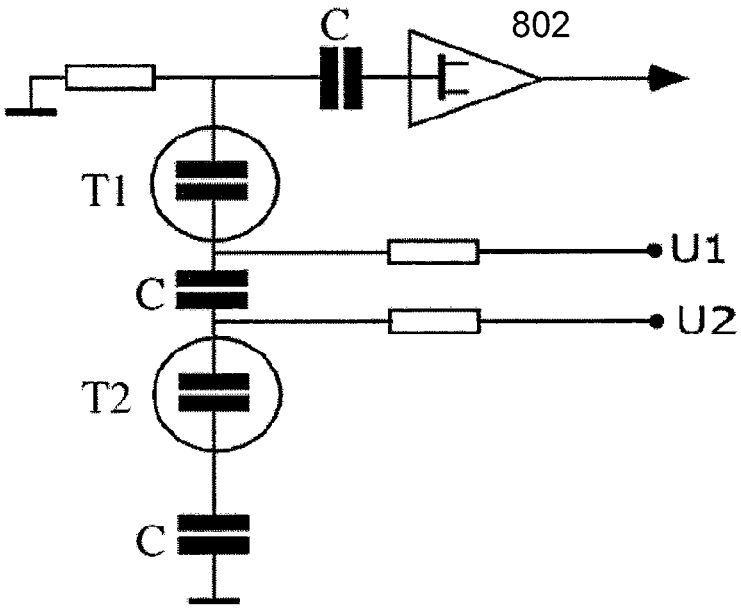
FIG. 8 is a layout of a double diaphragm.

FIG. 8 is a layout of double membrane system. Transducer systems T1, T2 are galvanically decoupled through capacitors C. Different polarization voltages U1 and U2 may be applied to the transducers. The directional pattern of each transducer may be adjusted separately through the magnitude and polarity of the polarization voltages U1, U2. The microphone signal of the microphone capsules connected in series may be transformed into the low impedance range in the impedance converter, before it is transmitted to the microphone output through cable driver units.

Figure 9:
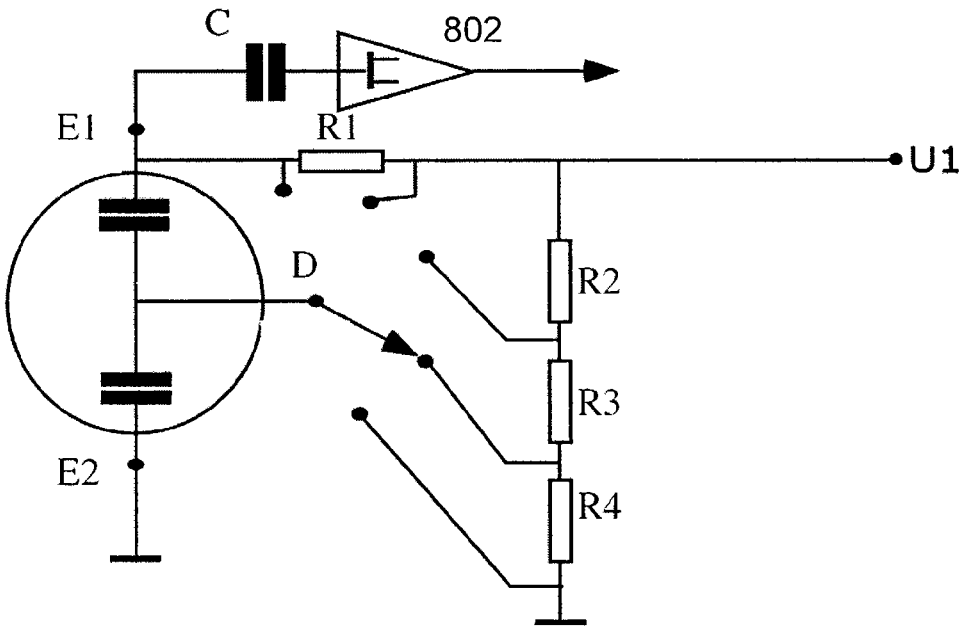
FIG. 9 is a transducer assembly have electrodes supplied with a polarization voltage.

In some systems, the transducer assembly may comprise an opened double-system. In FIG. 9, the circle around the two capacitors signifies the transducer system. E1 and E2 signify two separately contacted electrode areas, while D represents the connection to the diaphragm, which electronically couples both acoustic systems. In FIG. 8, both diaphragm sections are connected galvanically with each other. This may occur through a single, continuous electrically conductive layer, (e.g. a coating or an application of a conductive film, on the diaphragm sections 104, 124). An electrical conductor or conducting medium positioned between the two diaphragm sections is used in alternate systems.

A positive acoustic pressure that steers the diaphragm closer to both electrodes may cause the potential at both capacitors to be slightly reduced. This may be understood by formula Q=C×U (charge=capacity×applied voltage), since the charge on the capacitors may not dissipate fast enough due to the high impedance. The nature of the in-series connection of the two transducers may ensure that the resulting change in voltage, which reaches the impedance converter 802 (through the capacitor C), is the difference between the two changes in voltage at the two capacitors, each of which is formed by the diaphragm and an electrode.

A weighting of the transducer signals may make it adjust a resulting (or respectively synthesized) characteristic of the total signal. In FIG. 9, the transducers are biased with a polarization voltage U1, through a voltage divider (e.g., may be step-less). Because of the magnitude of the resistances (several giga-ohms) in some systems, a voltage divider may include discrete resistors R1, R2, R3, and R4.

Figure 10:
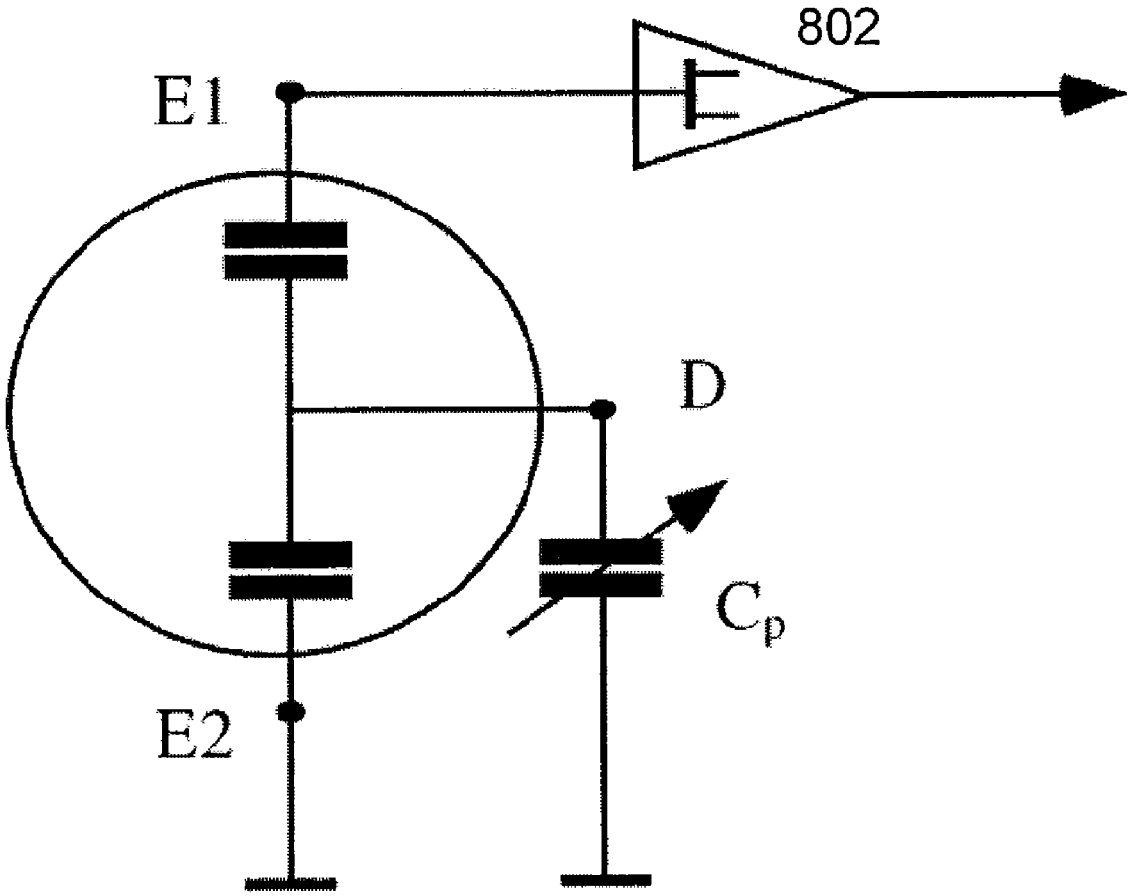
FIG. 10 is an alternative transducer layout having a transducer that operates according to the electret principle, FIG. 11 a layout of a transducer signals in a low impedance domain.

FIG. 10 is an alternative transducer layout with a transducer operating according to an electret effect. In FIG. 10, no polarization voltage is required. One of the transducer signals is attenuated by a parallel capacitance $C_p$. The capsule signal may be attenuated in a step-less manner. In other applications, the capsule signal is attenuated through a discrete switching.

Figure 14:
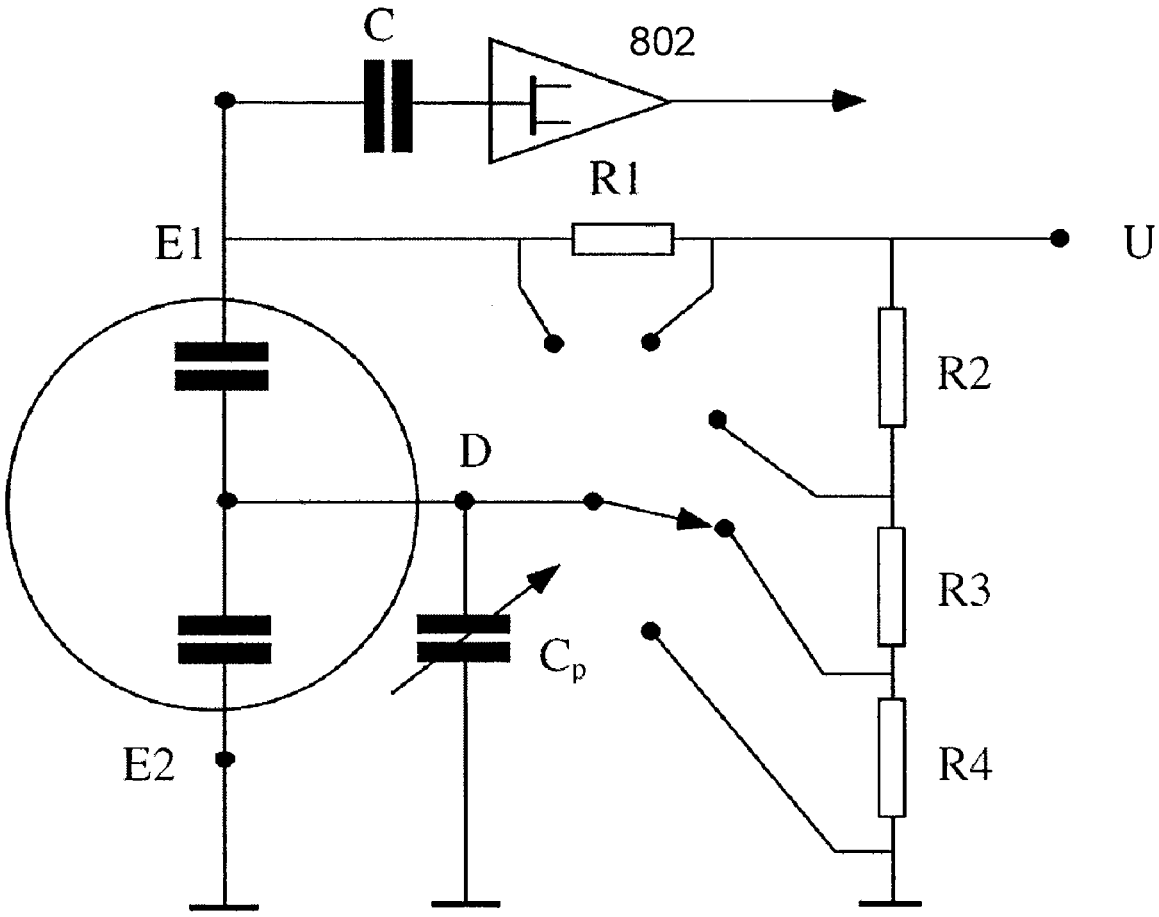
FIG. 14 an alternate transducer layout operating to an electret affect having an additional sensitivity control.

FIG. 14 shows an alternative system operating to an electret principle. Because of variations, which may be caused by mechanical aberrations, (e.g. manufacturing tolerances, material differences, etc.), the sensitivity of the individual transducers in the transducer assemblies may differ. The ratio of individual transducer sensitivities to each other may exhibit a variation. To set an absolute sensitivity, a DC voltage U may be applied to the electret, as in the case of a loaded capacitor. The magnitude of the DC voltage U required for this purpose may within the range of the supply voltage (for amplifiers, the remote control, and the like) since the sensitivity of the capsule is primarily determined by the charge of the electret layer. In FIG. 14, a high voltage generator (for the polarization voltage) may not be needed, which would be needed in a system using a capacitor. Perturbing voltage fluctuations of this additionally introduced DC voltage U, (e.g. noise), may only affect that percentage of the microphone signal that corresponds to the change in sensitivity due to the additionally applied DC voltage.

The wiring or conduction layers that conduct power to the capacitors or respectively the transducers may minimize cost. When capacitors are used, a second voltage supply that applies polarization voltages to a second transducer may not be needed.

Figure 11:
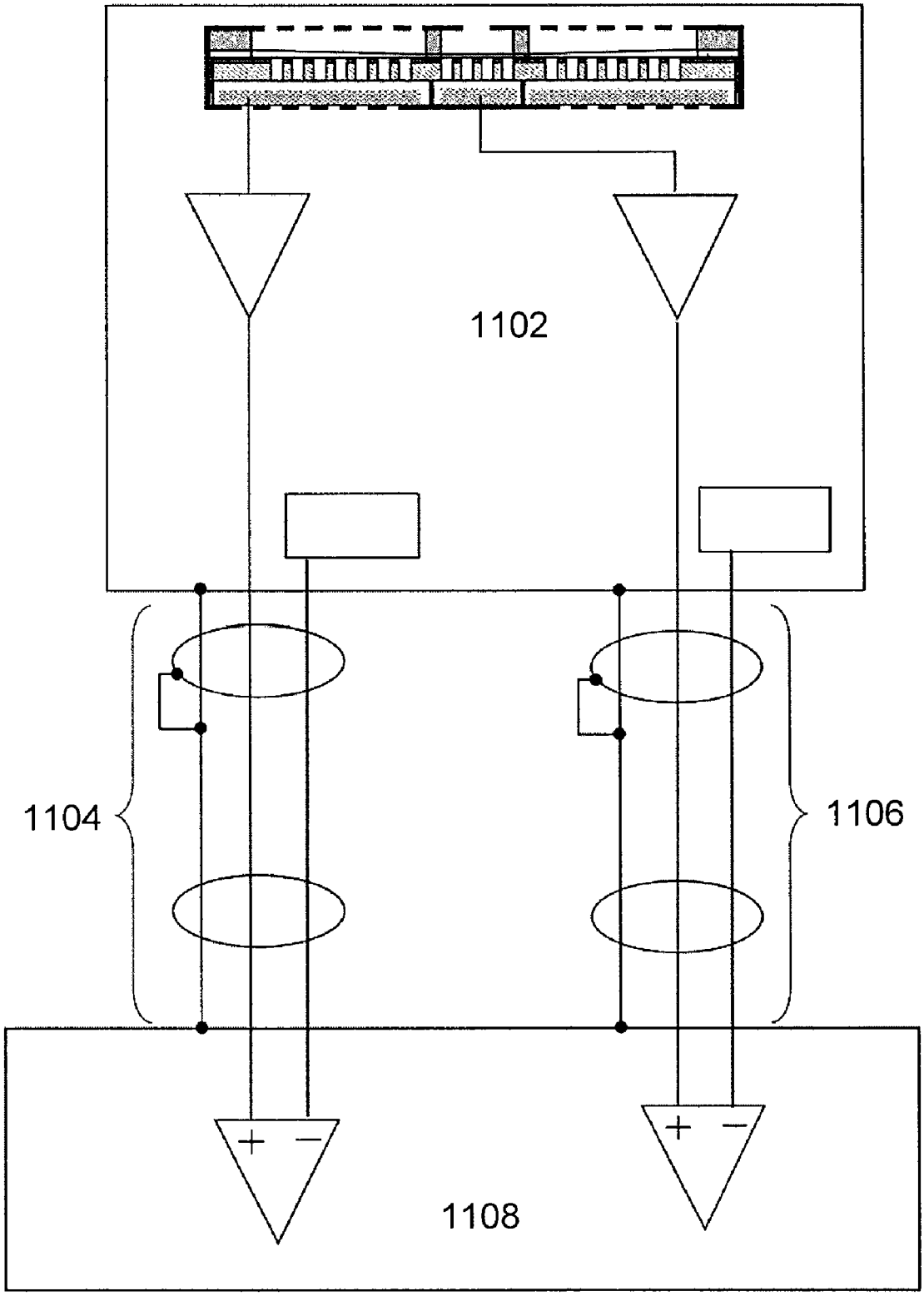

A second method of interconnecting the transducer signals may occur in a low impedance range. FIG. 11 shows a microphone 1102 (or a device that converts sounds into an analog signal/or operating signal) that accommodates a transducer assembly. The microphone 1102 is connected to a mixer 1108 through two microphone cables 1104, 1106. The merging of the two separately transmitted transducer signals may occur at the mixer 1108.

Figure 12:
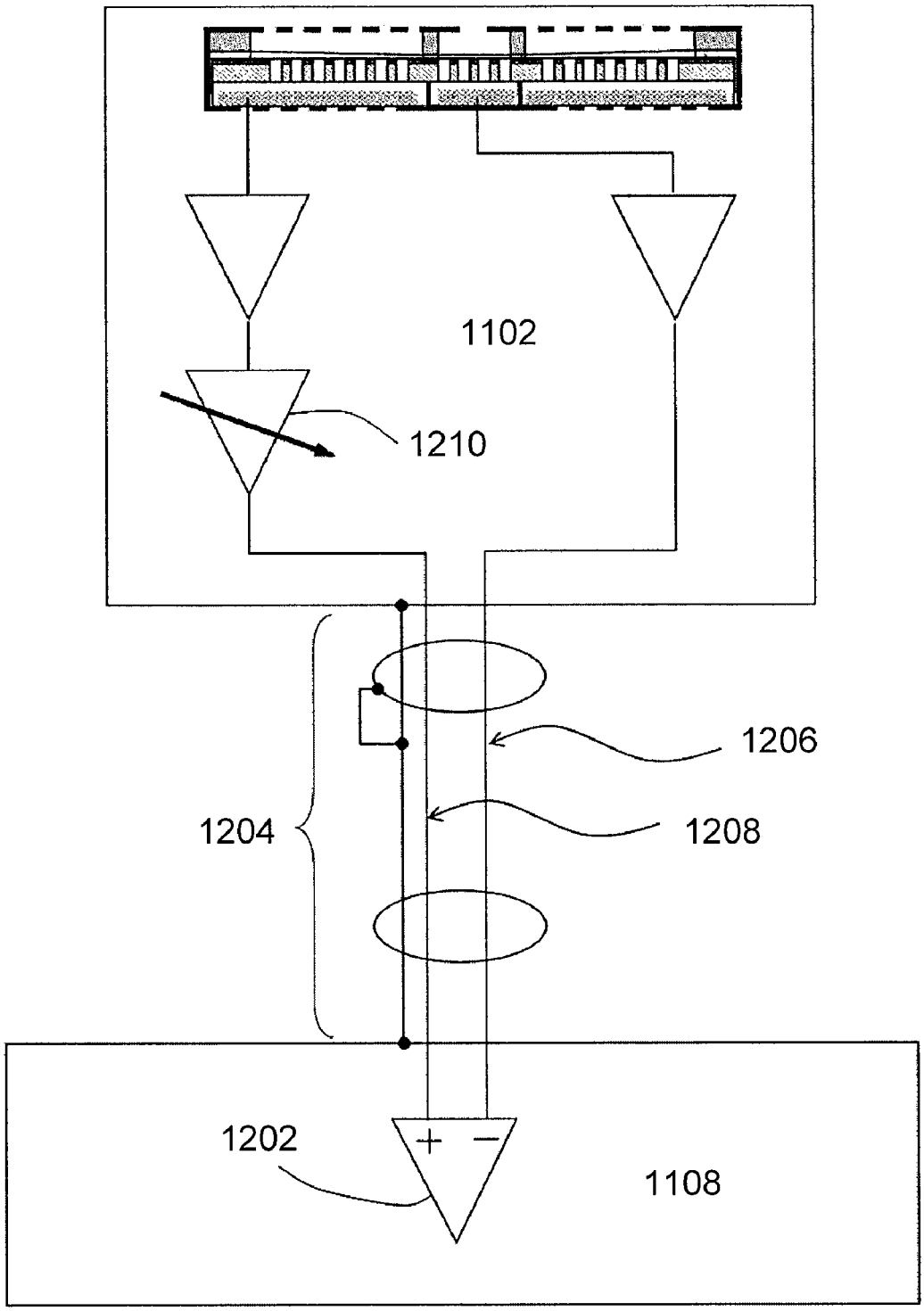
FIG. 12 an alternative layout of transducer signals in the low impedance domain.

In FIG. 12, an optional sum-and-difference amplifier 1202 may be part of the mixer 1108. In this arrangement the inverter stage in the microphone 1102 may not be needed (it may be omitted). By simultaneously connecting the "in-phase" lead 1206 of the microphone cable 1204 to a transducer signal, (e.g. the spherical signal), and the "out-phase" lead 1208 to the other transducer signal, (e.g. the gradient signal), the difference is formed by the mixer 1108. Interferences may be eliminated while the cross modulation has a minimal effect on signal attenuation. The ratio of the amplitudes of the two transducer signals and concomitantly of the desired directional pattern of the total signal may be changed by an attenuator/amplifier 1210.

Figure 13:
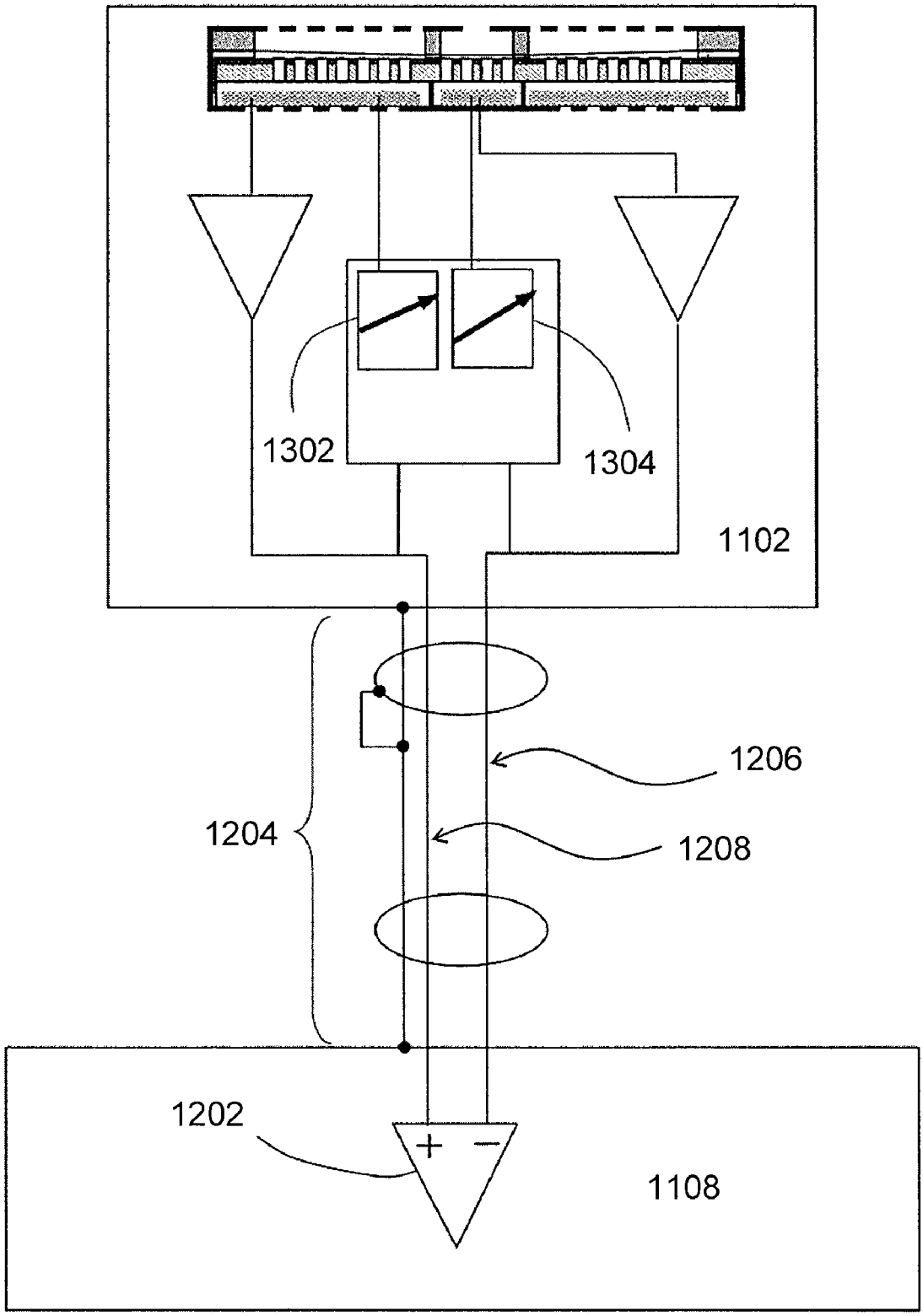
FIG. 13 an alternate layout of transducer signals in the low impedance domain.

To eliminate the attenuator/amplifier 37 that may minimize a certain amount of noise, the polarization voltage biasing the individual transducers 100, 120 may be varied. The varied bias may render the desired ratio between the two transducer signals in the synthesized microphone signal. In FIG. 13, the microphone renders two independently adjustable polarization voltage regulators 1302 and 1304 aside from the transducer assembly. Because of the different polarization voltages, the sensitivities of the individual electroacoustic transducers 100, 120 (and concomitantly their signal amplitude) also differ.

In some systems the two transducers 100, 120 are of the same type. In alternate systems an inner transducer comprises a gradient transducer and the outer transducer comprises a pressure transducer. Other alternate systems may include combinations of some or all of the structure and functions described above or shown in one or more or each of the Figures. These systems or methods are formed from any combination of structure and function described or illustrated within the Figures. Some alternative systems or devices compliant with one or more transceiver protocols that may communicate with one or more in-vehicle or out of vehicle receivers, devices or displays.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

I claim:

1. A transducer assembly comprising:

a first electroacoustic transducer and a second electroacoustic transducer each comprising an electrode and a counter electrode;

an outer diaphragm section, which is limited by an outer circumference and by an inner circumference lying within the outer circumference comprising the counter electrode of the first electroacoustic transducer: and an inner diaphragm section that lies within the inner circumference of the outer diaphragm section, comprising the counter electrode of the second electroacoustic transducer, where the inner diaphragm section and the outer diaphragm section comprise separate diaphragms spaced apart from each other.

2. The transducer assembly of claim 1 where the first electroacoustic transducer comprises a pressure gradient transducer and the second electroacoustic transducer comprises a pressure transducer.

3. The transducer assembly of claim 2 where the outer diaphragm section and the inner diaphragm section have a substantially circular outline and are substantially concentric.

4. The transducer assembly of claim 3 where the first electroacoustic transducer and the second electroacoustic transducer are positioned in a common capsule housing.

5. The transducer assembly of claim 1 where the first and the second electroacoustic transducers comprises a microphone.

6. A transducer assembly comprising:

a first electroacoustic transducer and a second electroacoustic transducer each comprising an electrode and a counter electrode;

an outer diaphragm section, which is limited by an outer circumference and by an inner circumference lying within the outer circumference comprising the counter electrode of the first electroacoustic transducer; and an inner diaphragm section that lies within the inner circumference of the outer diaphragm section, comprising the counter electrode of the second electroacoustic transducer, where the inner diaphragm section and the outer diaphragm section are galvanically separated from each other.

7. The transducer assembly of claim 6 where the first and the second electroacoustic transducers are coupled to an adjustable regulator having an output that polarizes the first electroacoustic transducer and the second electroacoustic transducer.

8. The transducer assembly according to claim 6 further comprising an amplifier that amplifies at least one of the outputs of the first electroacoustic transducer and the second electroacoustic transducer.

9. The transducer assembly according to claim 6 further comprising an attenuator that attenuates at least one of the outputs of the first electroacoustic transducer and the second electroacoustic transducer.

* * * * *

UNITED STATES PATENT AND TRADEMARK OFFICE

CERTIFICATE OF CORRECTION

PATENT NO. : 8,345,898 B2
APPLICATION NO. : 12/391015
DATED : January 1, 2013
INVENTOR(S) : Friedrich Reining It is certified that error appears in the above-identified patent and that said Letters Patent is hereby corrected as shown below:

In the Claims

In column 7, claim 1, line 9, immediately after "first electroacoustic transducer" replace ":" with --;--.

Signed and Sealed this
Nineteenth Day of March, 2013

Teresa Stanek Rea
*Acting Director of the United States Patent and Trademark Office*